US007053873B2

(12) United States Patent
Tsutsui

(10) Patent No.: US 7,053,873 B2
(45) Date of Patent: May 30, 2006

(54) DISPLAY DEVICE

(75) Inventor: Yusuke Tsutsui, Hashima (JP)

(73) Assignee: Sanyo Electric Co., Ltd., Osaka (JP)

( * ) Notice: Subject to any disclaimer, the term of this patent is extended or adjusted under 35 U.S.C. 154(b) by 469 days.

(21) Appl. No.: 10/253,884

(22) Filed: Sep. 25, 2002

(65) Prior Publication Data

US 2003/0085862 A1 May 8, 2003

(30) Foreign Application Priority Data

Sep. 25, 2001 (JP) ..... 2001-290641
Sep. 25, 2001 (JP) ..... 2001-290642
Sep. 25, 2001 (JP) ..... 2001-290643

(51) Int. Cl.
*G09G 3/36* (2006.01)
*G09G 5/00* (2006.01)

(52) U.S. Cl. ..... 345/76; 345/30; 345/55; 345/90; 345/98; 345/204; 345/205

(58) Field of Classification Search ..... 345/76
See application file for complete search history.

(56) References Cited

U.S. PATENT DOCUMENTS 5,945,972 A * 8/1999 Okumura et al. ..... 345/98
6,621,477 B1 * 9/2003 Inoue et al. ..... 345/92
6,781,567 B1 * 8/2004 Kimura ..... 345/92
6,853,371 B1 * 2/2005 Miyajima et al. ..... 345/206
2001/0005193 A1 * 6/2001 Yokoyama ..... 345/92
2001/0024186 A1 * 9/2001 Kane et al. ..... 345/98
2002/0021274 A1 * 2/2002 Koyama et al. ..... 345/98
2002/0021295 A1 * 2/2002 Koyama et al. ..... 345/205
2002/0036604 A1 * 3/2002 Yamazaki et al. ..... 345/76

* cited by examiner

*Primary Examiner*—Sumati Lefkowitz
*Assistant Examiner*—Alexander S. Beck
(74) *Attorney, Agent, or Firm*—Morrison & Foerster LLP

(57) ABSTRACT

The display device of this invention has a pixel element electrode 80, a plurality of drain signal lines 61 for supplying the digital image signals D0–D2, a plurality of capacitance elements C0–C2 with weighed capacitance value corresponding to the digital image signals D0–D2, a refresh transistor RT for initializing the voltage of the pixel element electrode 80 to the voltage Vsc, and charge transfer transistors TT0–TT2 for supplying the charge accumulated in the capacitance elements C0–C2 to the pixel element electrode 80. An image is displayed by supplying the analog image signal corresponding to the digital image signals D0–D2 to the pixel element electrode 80. The configuration of the peripheral circuits of the pixel element portion is simplified, leading to the reduction of the framing area of the panel.

3 Claims, 13 Drawing Sheets

DISPLAY DEVICE

BACKGROUND OF THE INVENTION

1. Field of the Invention

This invention relates to a display device, especially to a display device with a DA converter that converts a digital image signal to an analog image signal.

2. Description of Related Art

There has been a great demand on the market for portable communication and computing devices such as a portable TV and cellar phone. All these devices need a small, lightweight and low-energy consumption display device, and development efforts have been made accordingly.

FIG. 15 shows a circuit diagram corresponding to a display pixel element of a conventional liquid crystal display device. A plurality of the display pixel elements arranged in a matrix form configures the pixel element area in the liquid crystal display device.

A gate signal line 51 is disposed on an insulating substrate (not shown in the figure) in one direction and a drain signal line 61 is disposed in a direction perpendicular to the gate signal line 51. A pixel element selection thin film transistor 72 connected to both signal lines 51, 61 is formed near the crossing of the signal lines 51, 61. A thin film transistor will be referred to as a TFT hereinafter. A source 11*s* of the pixel element selection TFT 72 is connected to a pixel element electrode 80 of a liquid crystal 21.

Also, a storage capacitor 85 for holding the voltage of the pixel element electrode 80 for one field period is formed. One terminal 86 of the storage capacitor 85 is connected to the source 11*s* of the TFT 72, and the other terminal 87 is provided with a voltage commonly used among the pixel elements.

When a scanning signal (H level) is applied to the gate signal line 51, the pixel element selection TFT 72 turns on and an analog image signal is transmitted to the pixel element electrode 80 through the drain signal line 61 and retained in the storage capacitor 85. The image signal voltage applied to the pixel element electrode 80 is then applied to the liquid crystal 21. The liquid crystal aligns itself based on the voltage applied, forming an image in the liquid crystal display. Therefore, the liquid crystal can accommodate itself to both moving picture display and still picture display.

The analog image signal applied to the drain signal line 61 is obtained by converting an input digital image signal through an analog-digital conversion by a DA converter. The DA converter is formed near driver circuits in the peripheral area of the pixel element in the conventional liquid crystal display device having the DA converter inside a display panel.

However, since the DA converter is formed near the driver circuits in the conventional liquid crystal display device, the design of the circuits surrounding the pixel element portion becomes complicated, and increases the framing area for the display panel. Especially, when a gradation voltage is inputted from outside, the number of wiring increases in proportion to a square of the number of the gradation.

Also, the width of the area capable of accommodating the DA converter is limited, because the DA converter should be disposed corresponding to each row of the pixel elements. The maximum number of the bits of the DA converter, which can be put into this limited width, is four. Therefore, the conventional display device has a limitation in the number of the gradation.

SUMMARY OF THE INVENTION

This invention provides a display device with a plurality of pixel elements. Each of the pixel element has a pixel element electrode, a plurality of capacitance elements for accumulating a charge corresponding to each bit of the digital image signal, and a charge transfer transistor for supplying the charge accumulated in the capacitance elements to the pixel element electrode based on a timing signal.

This invention enables a simpler design of the peripheral circuit as well as size reduction of the framing area of the display panel because the conversion from digital image signal to analog image signal can be performed within the pixel element portion.

DETAILED DESCRIPTION OF THE INVENTION

Figure 1:
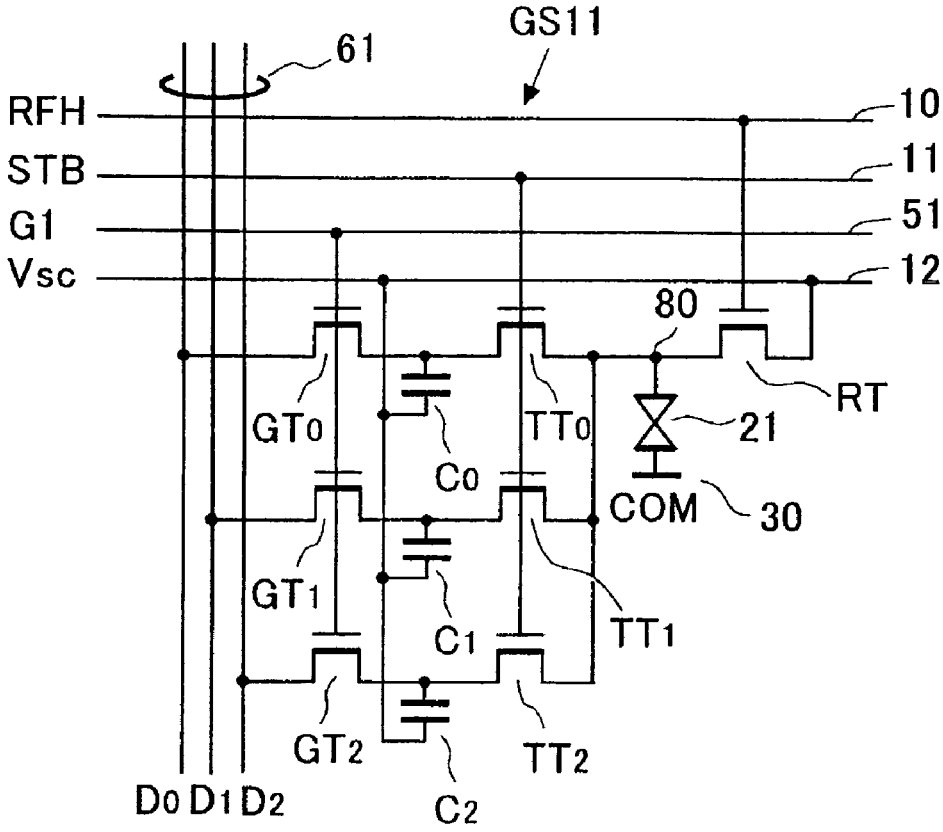
FIG. 1 is the circuit diagram of a liquid crystal display device of a first embodiment of this invention.

A display device of a first embodiment of this invention is explained by referring to the FIGS. 1–4. FIG. 1 shows a circuit diagram of the display device of the first embodiment of this invention. Only one pixel element portion is shown in the figure for the sake of simplicity. However, a plurality of pixel element portions are disposed in a matrix configuration in an actual display device.

On an insulating substrate (not shown in the figure), a gate signal line 51 is disposed in one direction. A scanning signal G1 is fed to the gate signal line 51 from a gate driver (not shown in the figure). Three drain signal lines 61 are disposed in a direction perpendicular to the gate signal line 51. Data corresponding to each bit of a digital image signal is inputted to the drain signal line 61 from outside. The lowest level bit, the digital image signal D0, is inputted to one of the drain signal lines 61 located on the left among the three drain signal lines in the figure, and the highest level bit, the digital image signal D2, to the drain signal line 61 located on the right. Although the number of the bits of the digital image signal is three in this embodiment, a multiple-depth display with more gradation levels is also possible by increasing the number of the bits. On the other hand, if the number of the bits of the digital image signal decreases, forming a shallow-depth display, the circuits located in the pixel element can be simplified.

Pixel element transistors GT0–GT2 are connected to the corresponding drain signal lines 61. And each of the pixel element transistors GT0–GT2 is configured from an N-type TFT (thin film transistor). The gate scanning signal G1 is fed to each gate of the pixel element selection transistors GT0–GT2. And each source of the pixel elements transistors is respectively connected to one of the capacitance elements C0–C2 that accumulate the bit data of the digital image signal sent through the pixel element transistors GT0–GT2.

The capacitance value of each of the capacitance elements C0–C2 is weighted based on each bit of the digital image signal. That is, when the capacitance element C0 corresponding to the lowest level bit has the capacitance value of C, the capacitance element C1 corresponding to the next level bit has the capacitance value of 2C and the capacitance element C2 corresponding to the highest level bit has the capacitance value of 4C respectively. For putting weight to the capacitance value in this manner, the area of the capacitance electrode of each capacitance element facing to a common electrode should be adjusted or the distance between the capacitance electrodes should be changed accordingly.

Charge transfer transistors TT0–TT2 are connected between a pixel element electrode 80 of a liquid crystal 21 and the pixel element selection transistors GT0–GT2. That is, the sources of the charge transfer transistors TT0–TT2 are commonly connected to the pixel element electrode 80. A driving signal COM is applied to a common electrode 30.

Each of the charge transfer transistors TT0–TT2 is an N-channel type TFT. A strobe signal line 11 is commonly connected to the gates of the charge transfer transistors TT0–TT2, supplying a strobe signal STB. When the strobe signal STB becomes high, the charge transfer transistors TT0–TT2 supply the charge accumulated in the capacitance elements C0–C2 to the pixel element electrode 80. Therefore, the voltage corresponding to the digital image signals D0–D2, which is the voltage after the digital-analog conversion, is applied to the pixel element electrode 80.

A refresh transistor RT is a transistor for initializing the voltage of the pixel element electrode 80 to a predetermined voltage Vsc. The drain of the refresh transistor is connected to the pixel element electrode 80, the source is connected to an initializing voltage line 12 provided with the voltage Vsc, and the gate is connected to a refresh signal line 10 that supplies a refresh signal RFH. That is, the refresh transistor RT turns on when the refresh signal RFH becomes high to initialize the voltage of the pixel element electrode 80 to the voltage Vsc.

Then, the charge transfer transistors TT0–TT2 turn on after the voltage of the pixel element electrode 80 is initialized by the refresh transistor RT, supplying the charge accumulated in the capacitance elements C0–C2 to the pixel element electrode 80. Therefore, the voltage corresponding to the digital image signals D0–D2 is always accurately fed to the pixel element electrode 80.

The voltage Vpix of the pixel element electrode 80 at this moment can be obtained from the following equation:

$$C\cdot VD(D0+2D1+4D2)+CLC\cdot Vsc=(C+2C+4C+CLC)\cdot Vpix$$

where the amplitude voltage of the digital image signals D0–D2 is DV and the capacitance of the liquid crystal 21 is CLC.

Therefore, the Vpix can be expressed by the following equation:

$$Vpix=[C\cdot VD(D0+2D1+4D2)+CLC\cdot Vsc]/(7C+CLC)$$

Next, the whole configuration of the liquid crystal display device described above will be explained by referring to FIGS. 2 and 3.

There are generally two types of liquid crystal display device, a point sequence type and a linear sequence type. The image signal is sequentially written into each of the pixel elements based on a sampling pulse in the liquid crystal display device of the point sequence type. On the other hand, the image signal for one horizontal period is retained based on the sampling pulse and the retained image signal is then outputted to each of the drain signal lines based on a transfer pulse in the liquid crystal display device of the linear-sequence type.

Figure 2:
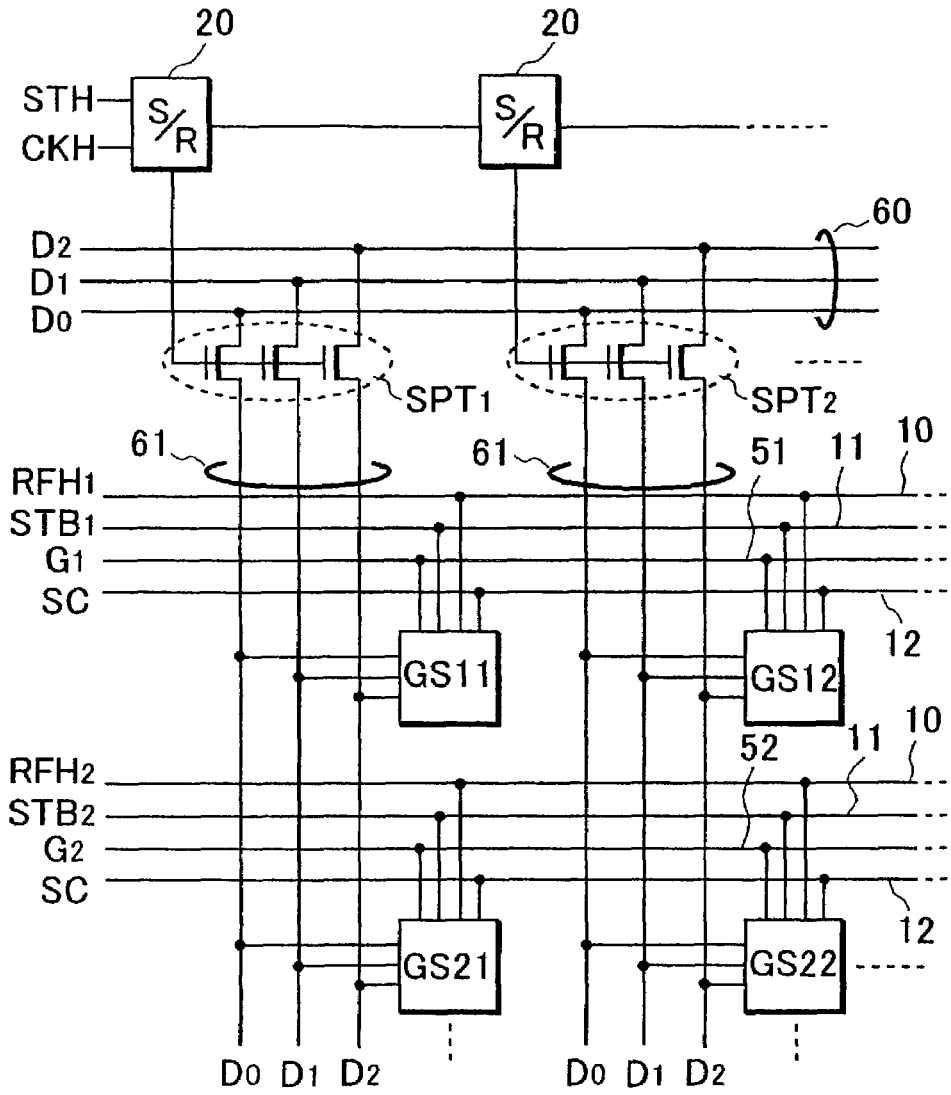
FIG. 2 is a circuit diagram of a point sequence type configuration using the pixel element shown in FIG. 1.

FIG. 2 is a circuit diagram showing an liquid crystal display device of the point-sequence type. The pixel elements GS12, GS21, GS22, - - - , which are the same pixel element as the pixel element GS 11 in FIG. 1 are arranged in a matrix configuration. A refresh signal RFH1, a strobe signal STB1, a scanning signal GI and the voltage Vsc for initialization are supplied to the pixel elements GS11, GS12, - - - , located in the first row. Likewise, the refresh signal RFH2, a strobe signal STB2, a scanning signal G2 and the voltage Vsc for initialization are supplied to the pixel element GS21, GS22, - - - , located in the second row.

The digital image signals D0–D2 are supplied to three signal lines 60. Each column of the matrix is provided with one of sampling transistors SPT1, SPT2, - - - , that sample the digital image signals D0–D2 on the signal lines 60 and supply them to the drain signal line 61. The gates of the sampling transistors ST1, ST2, - - - , receive the sampling pulse from a shift resistor 20.

A shift resistor 20 generates the sampling pulse, which is a pulse sequentially shifted from a horizontal start signal STH, based on a horizontal clock CKH. The sampling transistors SPT1, SPT2, - - - , sequentially turn on based on the sampling pulse, sampling and supplying the digital image signals D0–D2 to the drain signal line 61.

Figure 3:
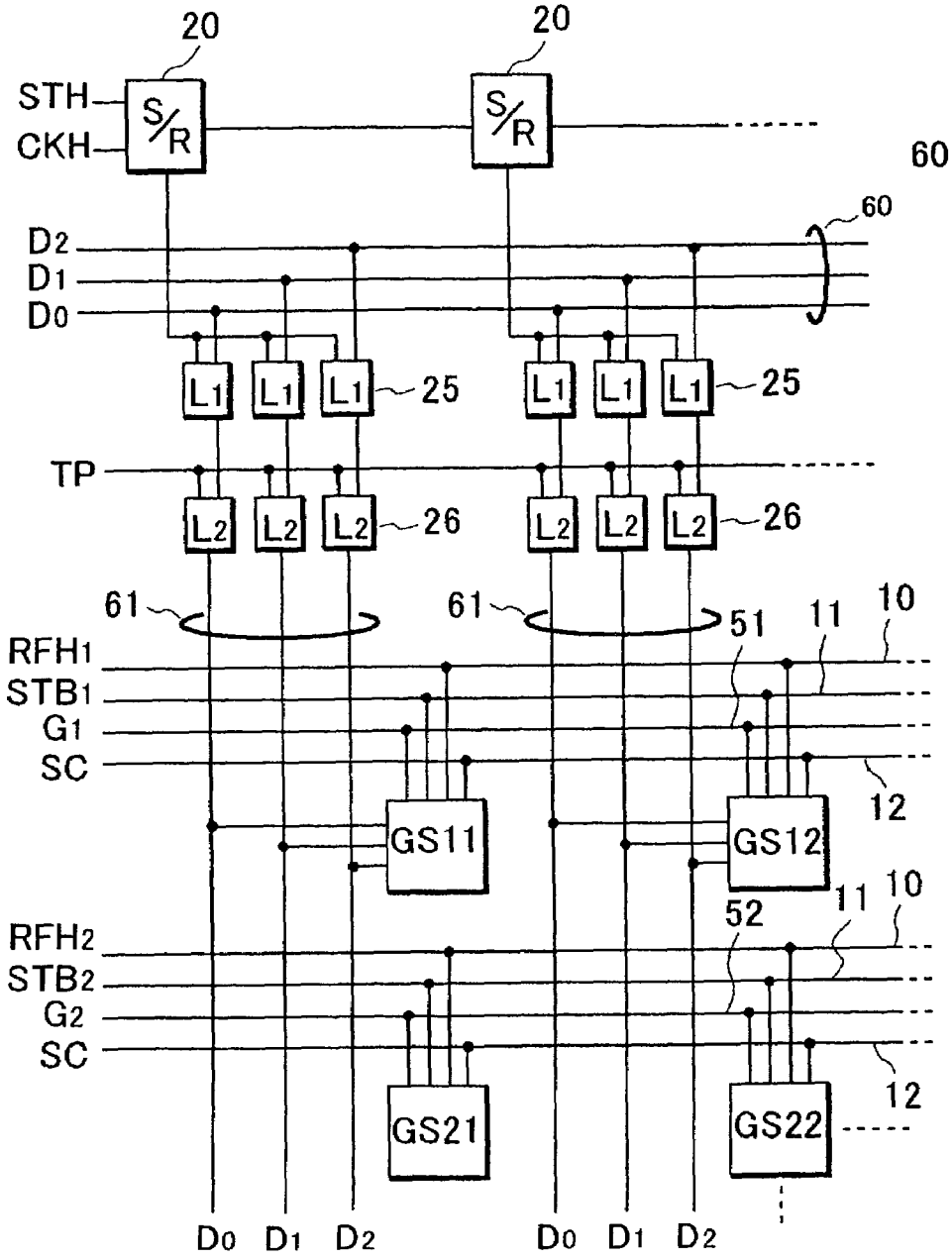
FIG. 3 is a circuit diagram of a linear sequence type configuration using the pixel element shown in FIG. 1.

FIG. 3 is the circuit diagram showing an liquid crystal display device of the linear-sequence type. The configuration of the pixel element area is exactly the same as that of the point-sequence type. Thus, explanation will be omitted. The digital image signals D0–D2 are sequentially supplied to the three signal lines 60. A first latch circuit 25 for latching the digital image signals D0–D2 is formed for each column.

The latch circuit 25 samples the digital image signals D0–D2 on the signal line 60 based on the sampling pulse and holds them for one horizontal period. The shift resistor 20 generates the sampling pulse. That is, the shift resistor 20 generates the sampling pulse, which is a pulse sequentially shifted from the horizontal start signal, based on a horizontal clock CKH.

The digital image signals D0–D2 retained in the first latch circuit 25 is then latched to a second latch circuit 26 based on the transfer pulse generated after one horizontal field period and simultaneously outputted to the drain signal line 61.

Figure 4:
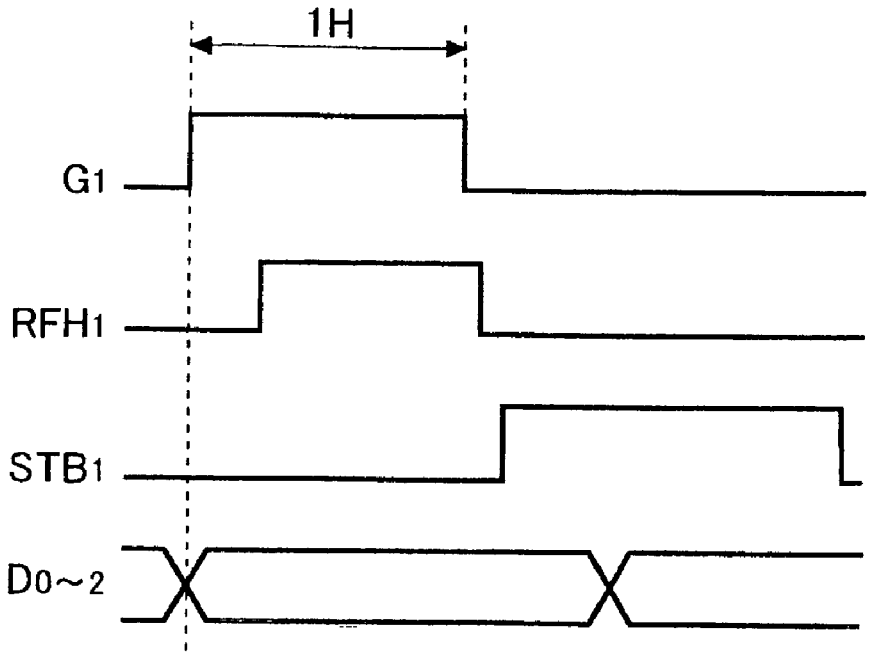
FIG. 4 is a timing chart showing the operation of the liquid crystal display device of the first embodiment of this invention.

Next, the operation timing of the liquid crystal display device described above will be explained. FIG. 4 is a timing chart of the liquid crystal display device. An example where the pixel element GS 11 shown in FIG. 1 displays an image will be explained. The scanning signal G1, the refresh signal RFH1 and the strobe signal STB 1 are at low-level and the pixel element selection transistors GT0–GT2, the refresh transistor RT and the charge transfer transistors TT0–TT2 are all off. From this condition, the scanning signal G1 becomes high for one field period.

Then, the pixel element transistors GT0–GT2 turn on and the capacitance elements C0–C2 start accumulating the charge corresponding to each bit of the digital image signals D0–D2. The timing of the change of the digital image signal depends on the type of the liquid crystal display device, the point-sequence type or the linear-sequence type. The timing for the digital image signal to change is synchronized with the timing for the sampling pulse to be generated in the point-sequence type. Therefore, the timing is shifted sequentially for each column of the pixel elements. On the other hand, the timing is synchronized with the transfer pulse in the linear sequence type. Thus, the timing is stable among the pixel elements.

When the refresh signal RFH1 becomes high, the refresh transistor turns on. Then, the charge, which has been accumulated in the pixel element electrode 80, is discharged, initializing the voltage to the voltage Vsc.

Next, the scanning signal G1 goes down, turning the pixel element selection transistors GT0–GT2 off. Therefore, both the pixel element selection transistors GT0–GT2 and the charge transfer transistors TT0–TT2 turn off, electrically isolating the capacitance elements C0–C2 for a certain period of time. Then, when the refresh signal RFH goes down, the refresh transistor RT turns off, electrically isolating the pixel element electrode 80.

Then, the strobe signal STB1 becomes high, the charge transfer transistors TT0–TT2 turn on, feeding the charge accumulated in the capacitance elements C0–C2 to the pixel element electrode 80 through the charge transfer transistors TT0–TT2. Therefore, the voltage corresponding to the digital image signals D0–D2, that is the voltage Vpix after the digital-analog conversion, is applied to the pixel element electrode 80 of the liquid crystal 21, forming a multiple-depth image corresponding to the digital image signals D0–D2.

The first embodiment of this invention described above is the liquid crystal display device of the voltage-control type. However, this invention is also applicable to a display device of the current-control type, including an electroluminescenct (EL) display device as shown in the fifth embodiment of this invention. Replacing the liquid crystal 21 with an EL element and an EL drive transistor can configure the electroluminescenct device. The same applies to the second, third and fourth embodiments of this invention.

Figure 5:
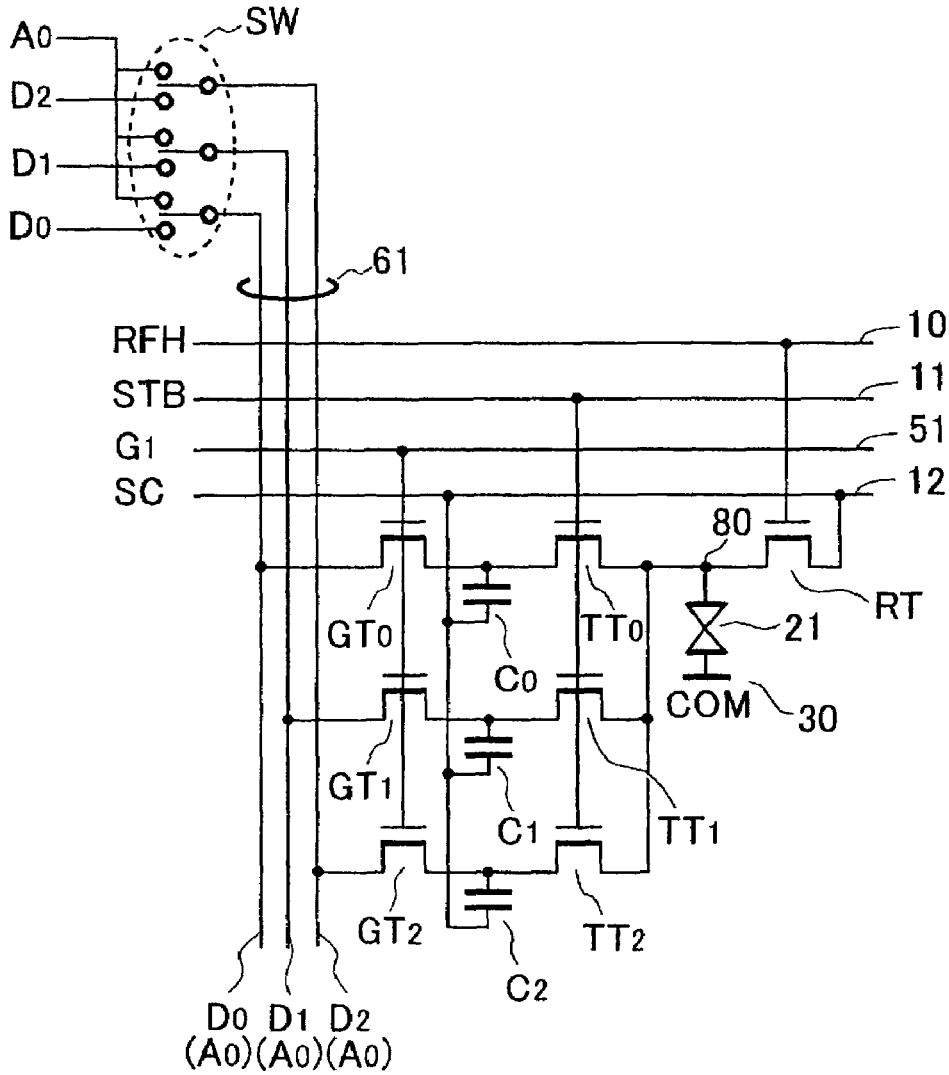
FIG. 5 is a circuit diagram of a liquid crystal display device of a second embodiment of this invention.
Figure 6:
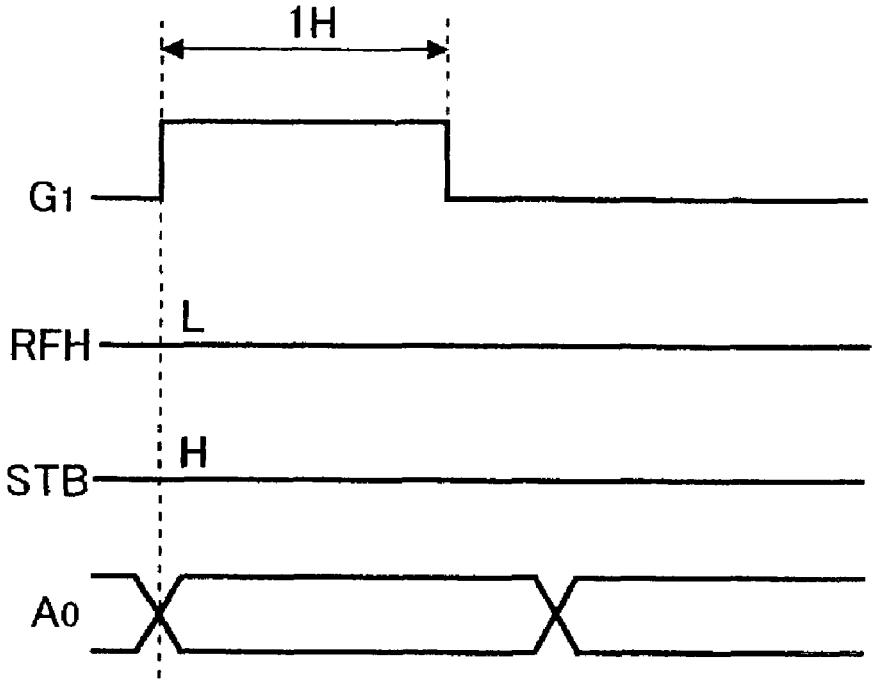
FIG. 6 is a timing chart showing the operation of the liquid crystal display device of the second embodiment of this invention under analog mode.

Next, a second embodiment of this invention will be explained by referring to FIGS. 5 and 6. FIG. 5 is a circuit diagram of a liquid crystal display device of the second embodiment. Only one pixel element portion is shown in the figure for the sake of simplicity. However, a plurality of pixel element portions are disposed in a matrix configuration in an actual display device. A signal changing switch SW for switching between the digital image signals D0–D2 and an analog image signal A0 and supplying the selected signal to the three drain signal lines 61 is formed in this embodiment. A mode under which the signal changing switch SW selects the analog signal A0 is referred to as an analog mode, and a mode under which the signal changing switch SW selects the digital signals D0–D2 is referred to as a digital mode hereinafter. Other circuit configurations are the same as those in the display device shown in FIG. 1.

The operation timing of the liquid crystal display device described above will be explained. The digital image signals D0–D2 are outputted to the drain signal line 61 under the digital mode as in the first embodiment. The operation is completely the same as that of the first embodiment. Also, the timing chart of this embodiment is completely the same as that shown in FIG. 4.

On the other hand, the analog image signal A0 is outputted to the three drain signal lines 61 through the switching of the signal changing switch SW under the analog mode. Next, the operation under the analog mode will be explained by referring to the timing chart shown in FIG. 6.

Figure 15:
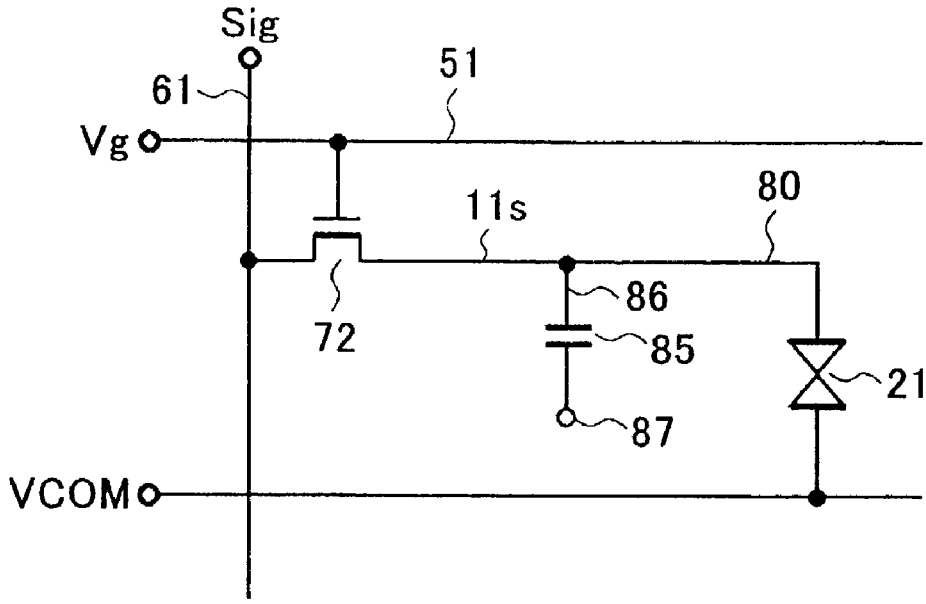
FIG.15 PRIOR ART
FIG. 15 is a circuit diagram of a conventional liquid crystal display device.

In this case, the refresh signal RFH is always at low-level and the strobe signal is always at high-level, always turning the refresh transistor RT off and the charge transfer transistors TT0–TT2 on. When the scanning signal G1 becomes high for one horizontal period, the pixel element selection transistors GT0–GT2 turn on and the voltage corresponding to the analog image signal A0 is supplied to the pixel element electrode 80 of the liquid crystal 21. That is, the display pixel element functions in the same manner as the display pixel element of the prior arts shown in FIG. 15 under the analog mode. The capacitance elements C0–C2 also work as the storage capacitor 85 and the pixel element selection transistors GT0–GT2 work as the transistor 72.

Figure 7:
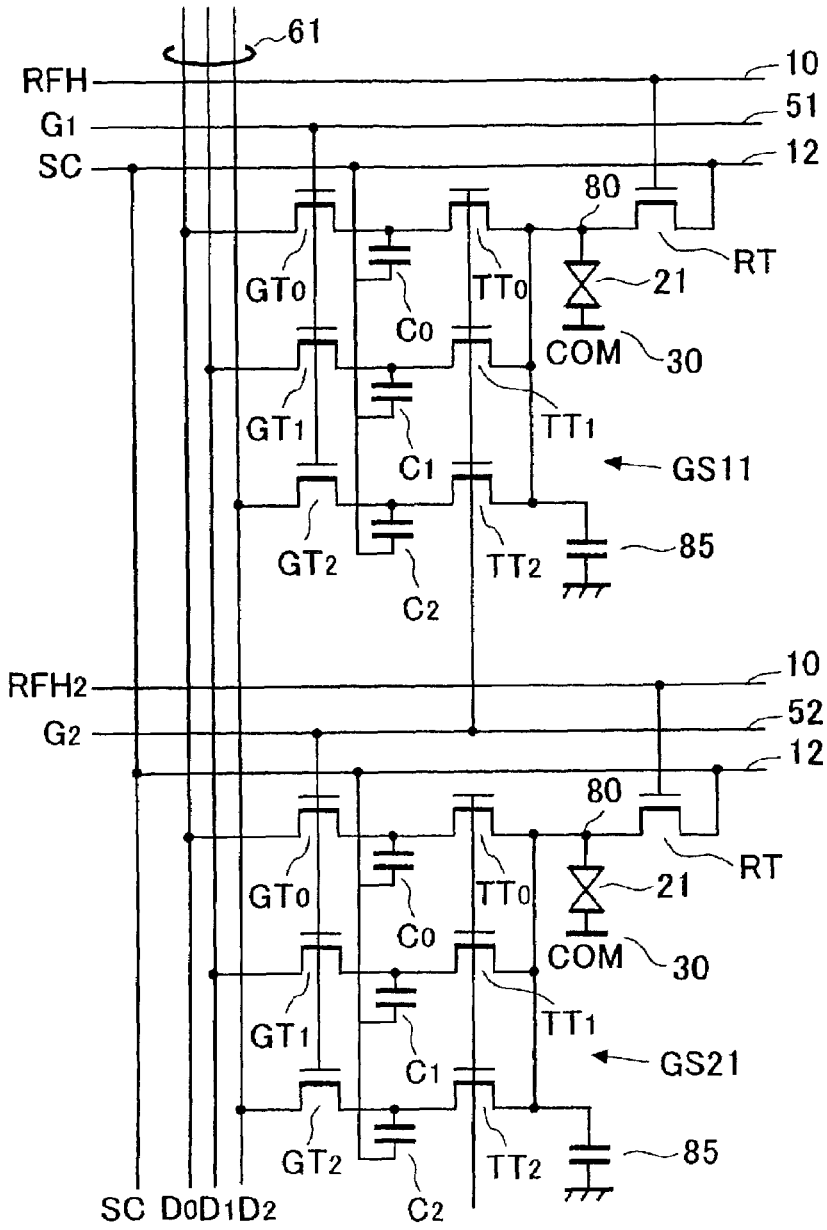
FIG. 7 is a circuit diagram of the liquid crystal display device showing the third embodiment of this invention.
Figure 8:
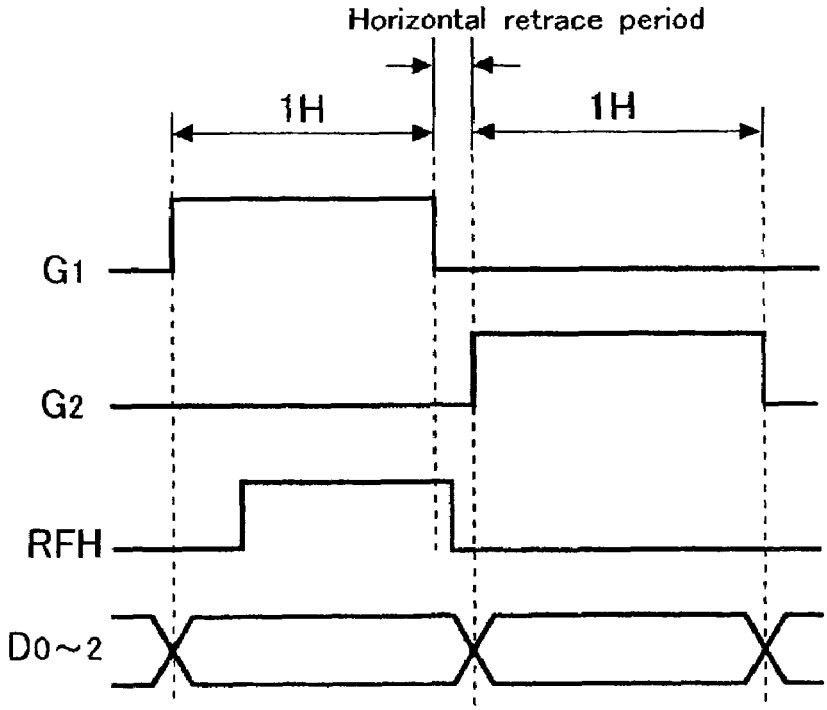
FIG. 8 is the timing chart showing the operation of the liquid crystal display device of the third embodiment of this invention.

Next, a third embodiment of this invention will be explained by referring to FIGS. 7 and 8. FIG. 7 is a circuit diagram of the liquid crystal display device of the third embodiment. Only one pixel element portion is shown in the figure for the sake of simplicity. However, a plurality of pixel element portions are disposed in a matrix configuration in an actual display device.

The layout of the display device of this embodiment is a simplified version of the display device of the first embodiment. As explained above, the charge transfer transistors TT0–TT2 need to be on for a certain period of time after the pixel element selection transistors GT0–GT2 turn off. Therefore, the gates of the charge transfer transistors GT0–GT2 are connected to the gate signal line 52 located at the adjacent column for supplying the scanning signal G2.

The strobe signal line 11 for controlling the charge transfer transistors TT0–TT2 can be omitted in this manner, reducing the size of the pixel element. The charge transfer transistors TT0-TT2 turn on only for one horizontal period (during the scanning signal G2 stays at high-level), and turn off afterwards. Therefore, the capacitance elements C0–C2 do not sufficiently function as the storage capacitance element. Thus, it is necessary to form the storage capacitor 85 for keeping the voltage of the pixel element electrode 80 stable for one field period.

The operation timing of the liquid crystal display device described above will be explained. FIG. 8 is the operation-timing chart of this liquid crystal display device. The scanning signal G1, the refresh signal RFH and the strobe signal are all at low-level and the pixel element selection transistors GT0–GT2, the refresh transistor RT and the charge transfer transistors TT0–TT2 are all off. The scanning signal G1 becomes high from this condition for one horizontal period.

Then, the pixel element transistors GT0–GT2 turn on and the capacitance elements C0–C2 start accumulating the charge corresponding to each bit of the digital image signals D0–D2. Then, when the refresh signal RFH1 becomes high, the refresh transistor turns on, and the charge, which has been accumulated in the pixel element electrode 80, is discharged, initializing the voltage to the voltage Vsc. Next, the scanning signal G1 goes down, turning the refresh transistor RT off. Then, at the end of one horizontal period, the scanning signal G2 becomes high for the next one horizontal period after a horizontal retrace period. Then, the charge transfer transistors TT0–TT2 turn on, feeding the charge accumulated in the capacitance elements C0–C2 to the pixel element electrode 80 through the charge transfer transistors TT0–TT2. Therefore, the voltage corresponding to the digital image signals D0–D2, that is the voltage Vpix after the digital-analog conversion, is applied to the pixel element electrode 80 of the liquid crystal 21, obtaining the multiple-depth display corresponding to the digital image signals D0–D2.

Figure 9:
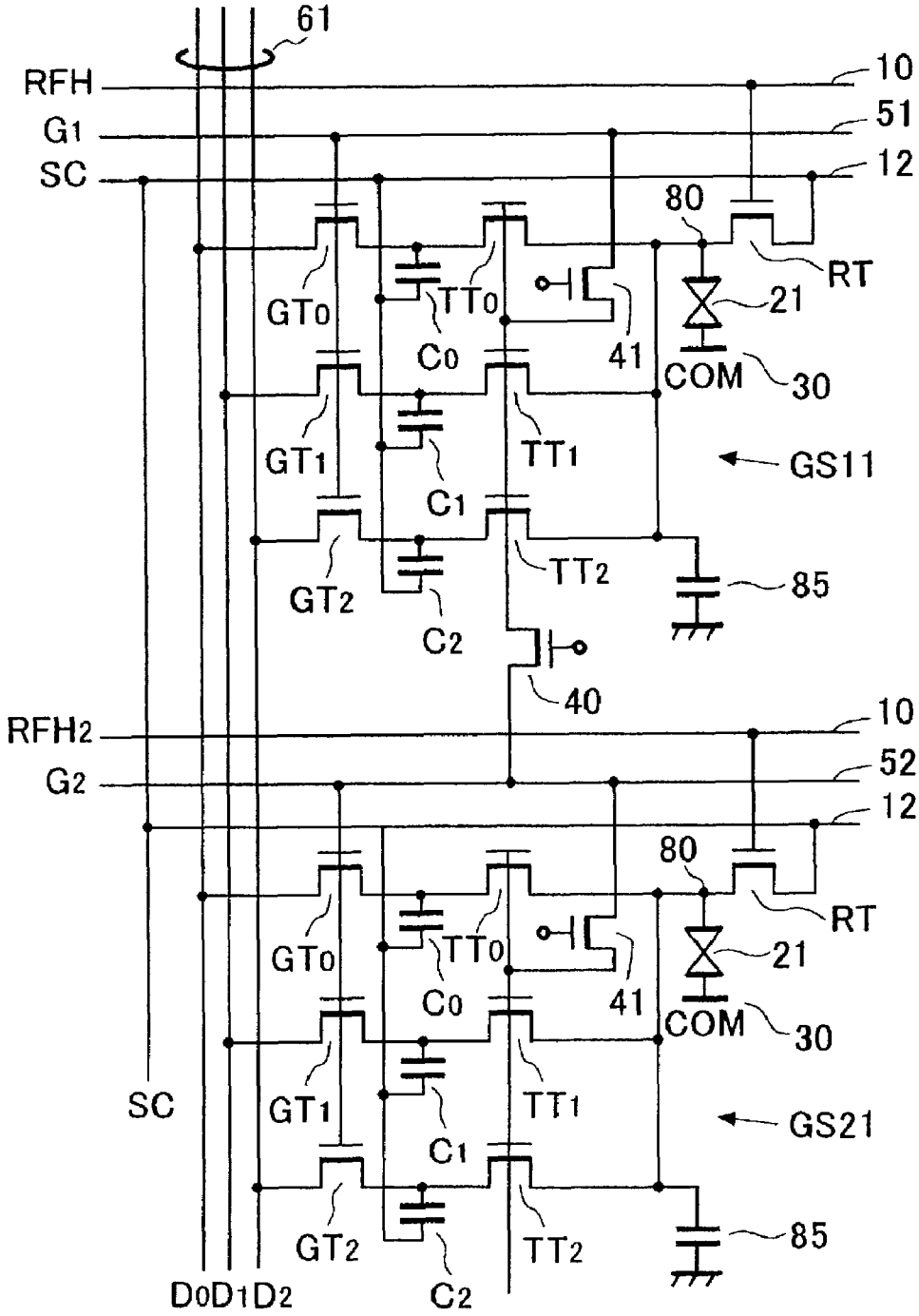
FIG. 9 is another circuit diagram of the liquid crystal display device of the third embodiment of this invention.

In addition to the configuration described above, the signal changing switch SW for switching between the digital image signals D0–D2 and the analog image signal A0 and supplying the selected signal to the three drain signal lines 61 can also be disposed in this embodiment. In this case, a transistor 40 for separating the gates of the charge transfer transistors TT0–TT2 from the gate signal line 52 and a transistor 41 for connecting the separated gates of the charge transfer transistors TT0–TT2 to the gate signal line 51 under the analog mode can also be disposed as seen from FIG. 9.

The scanning signal G2 from the next column is fed to the gates of the charge transfer transistors TT0–TT2 under the digital mode, but the scanning signal G1 of its column is fed under the analog mode. Therefore, in addition to the fact that the multiple-depth display corresponding to the digital image signals D0–D2 is provided under the digital mode in the same manner as described above, a multiple-depth display corresponding to the analog image signal A0 can also be provided under the analog mode.

However, the transistors 40, 41 described above are not necessarily needed when the signal changing switch SW makes the switching between the digital mode and the analog mode. One of such examples is the case where two columns are selected simultaneously. That is, the gate driver is configured in such way that the scanning signals G1 and G2 become high at the same time.

Figure 10:
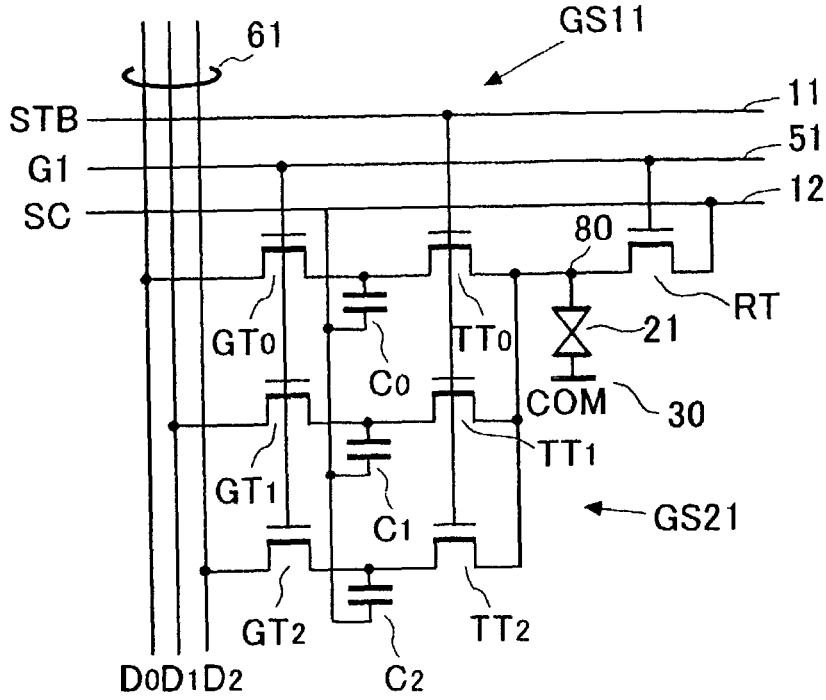
FIG. 10 is a circuit diagram of a liquid crystal display device of a fourth embodiment of this invention.
Figure 11:
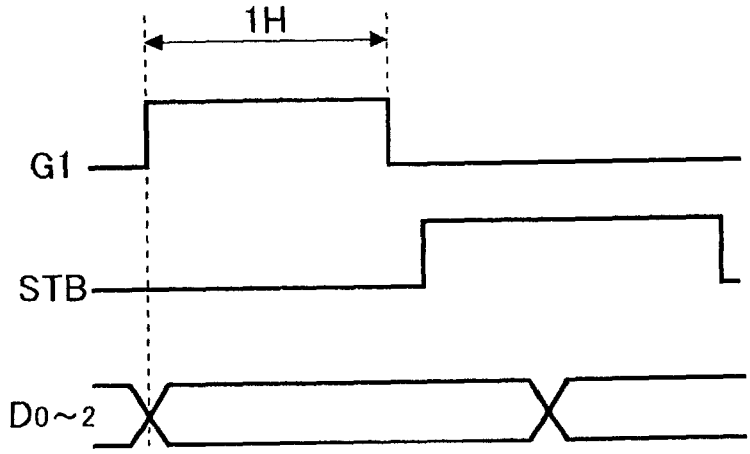
FIG. 11 is a timing chart showing the operation of the liquid crystal display device of the fourth embodiment of this invention.

Next, a fourth embodiment of this invention applied to the display device will be explained by referring to FIGS. 10 and 11. FIG. 10 is a circuit diagram of the liquid crystal display device of the third embodiment. Only one pixel element portion is shown in the figure for the sake of simplicity. However, a plurality of pixel element portions are disposed in a matrix configuration in an actual display device.

The layout of the display device of this embodiment is a simplified version of the display device of the first embodiment. The refresh transistor RT initializes the pixel element electrode 80 of the liquid crystal to the voltage Vsc. The initialization is performed before the charge accumulated in the capacitance elements C0–C2 is supplied to the pixel element electrode 80 through the charge transfer transistors TT0–TT2. Therefore, refresh transistor RT should turn on before the charge transfer transistors TT0–TT2 turn on. The gate of the refresh transistor RT is connected to the gate signal line 51 of the pixel element GS11 in this embodiment. Other configuration is the same as that of the first embodiment. In this embodiment, the refresh signal line 10 for supplying the refresh signal RFH can be omitted, leading to size reduction of the pixel element area.

The operation timing of the liquid crystal display device described above will be explained. FIG. 11 is the timing chart of the liquid crystal display device. The scanning signal G1 and the strobe signal are at low-level and the pixel element selection transistors GT0–GT2, the refresh transistor RT and the charge transfer transistors TT0–TT2 are all off. The scanning signal G1 becomes high from this condition for one horizontal period.

Then, the pixel element transistors GT0–GT2 turn on and the capacitance elements C0–C2 start accumulating the charge corresponding to each bit of the digital image signals D0–D2. The refresh transistor RT turns on simultaneously and the charge, which has been accumulated in the pixel element electrode 80, is discharged, initializing the voltage to the voltage Vsc.

Then, the scanning signal G1 goes down after one horizontal period, turning the pixel element selection transistors GT0–GT2 and the refresh transistor RT off. Then, when the strobe signal STB becomes high, the charge transfer transistors TT0–TT2 turn on, feeding the charge accumulated in the capacitance elements C0–C2 to the pixel element electrode 80 through the charge transfer transistors TT0–TT2. Therefore, the voltage corresponding to the digital image signals D0–D2, that is the voltage Vpix after the digital-analog conversion, is applied to the pixel element electrode 80 of the liquid crystal 21, forming a multiple-depth image corresponding to the digital image signals D0–D2.

Figure 12:
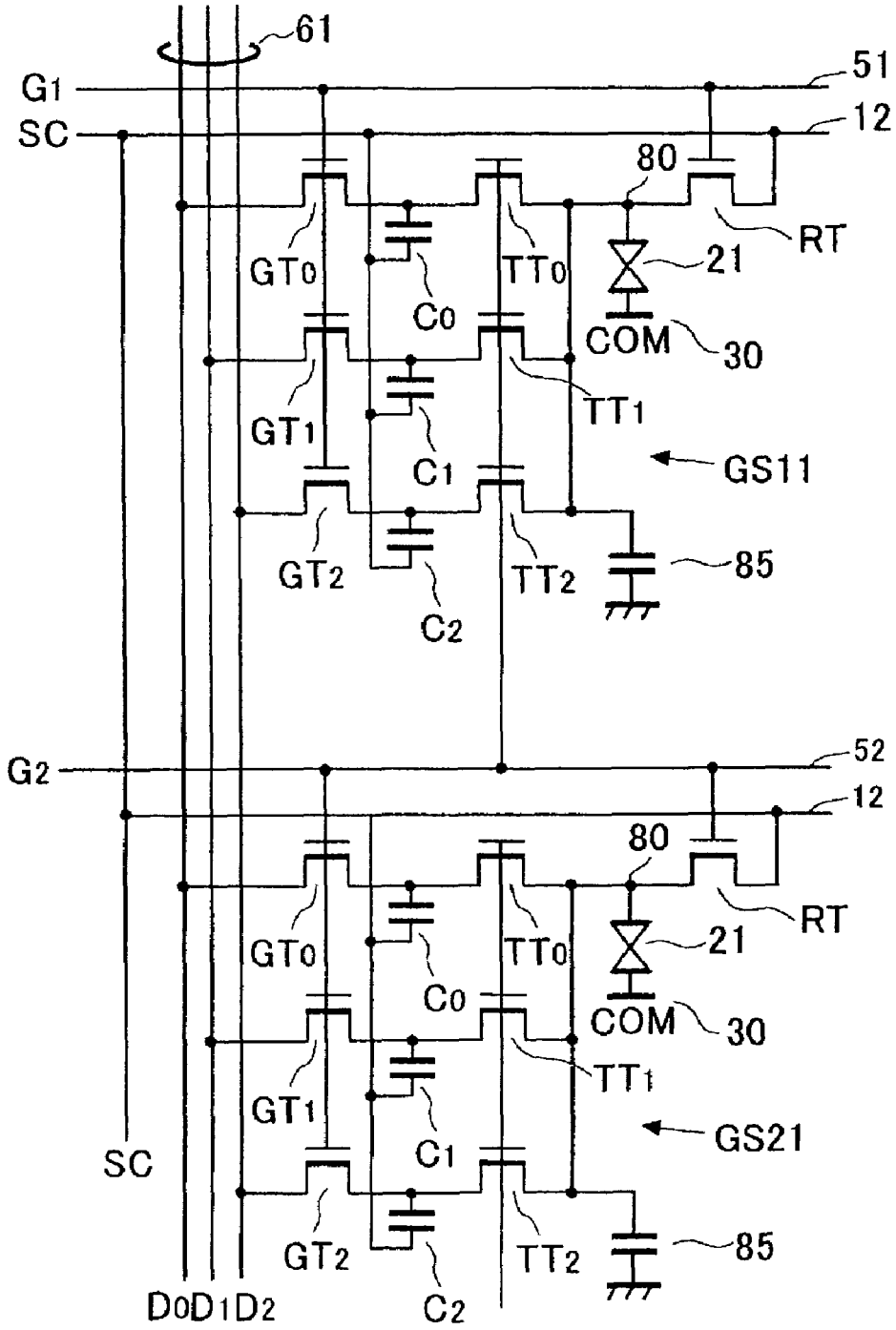
FIG. 12 is another circuit diagram of the liquid crystal display device of the fourth embodiment of this invention.

In the fourth embodiment described above, it is also possible to connect the gates of the charge transfer transistors GT0–GT2 to the gate signal line 52 located at the adjacent row for supplying the scanning signal G2 as in the third embodiment. The circuit diagram of such liquid crystal display device is shown in FIG. 12. In addition to the refresh signal line 10, the strobe signal line 11 can be omitted, leading to the further reduction of the pixel element area.

Figure 13:
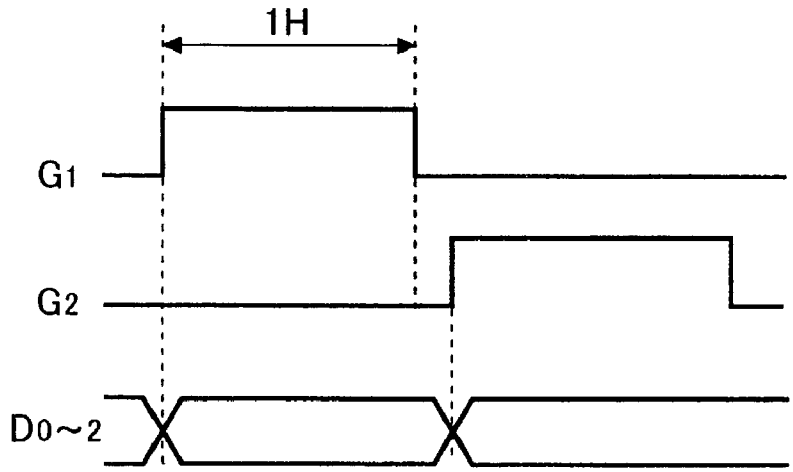
FIG. 13 is a timing chart showing the operation of the liquid crystal display device of the fourth embodiment of this invention.

The operation timing of the liquid crystal display device described above will be explained. FIG. 13 is the operation-timing chart of the liquid crystal display device. The scanning signal G1 and the strobe signal are at low-level and the pixel element selection transistors GT0–GT2, the refresh transistor RT and the charge transfer transistors TT0–TT2 are all off. The scanning signal G1 becomes high from this condition for one horizontal period.

Then, the pixel element transistors GT0–GT2 turn on and the capacitance elements C0–C2 start accumulating the charge corresponding to each bit of the digital image signals D0–D2. The refresh transistor RT turns on simultaneously and the charge, which has been accumulated in the pixel element electrode 80, is discharged, initializing the voltage to the voltage Vsc.

Then, the scanning signal G1 goes down to low-level, turning the pixel element selection transistors GT0–GT2 and the refresh transistor RT off. Then, at the end of one horizontal period, the scanning signal G2 becomes high for the next one horizontal period after the horizontal retarace period. Then, the charge transfer transistors TT0–TT2 turn on, feeding the charge accumulated in the capacitance elements C0–C2 to the pixel element electrode 80 through the charge transfer transistors TT0–TT2. Therefore, the voltage corresponding to the digital image signals D0–D2, that is the voltage Vpix after the digital-analog conversion, is applied to the pixel element electrode 80 of the liquid crystal 21, obtaining the multiple-depth display corresponding to the digital image signals D0–D2.

Figure 14:
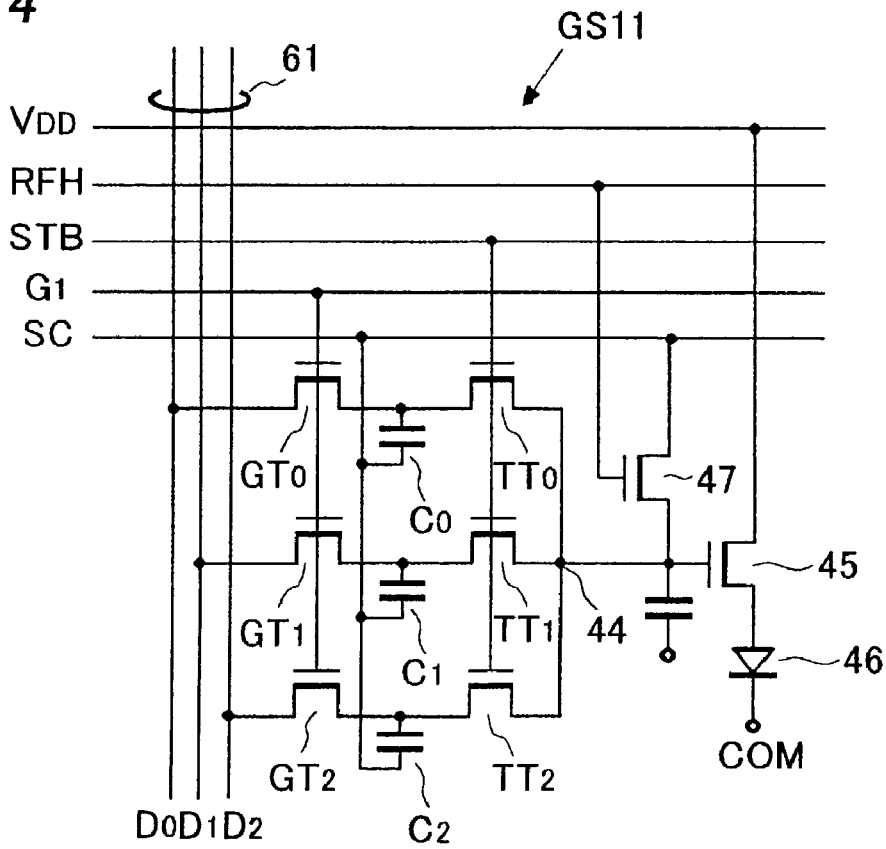
FIG. 14 is a circuit diagram of the electroluminescenct display device of a fifth embodiment of this invention.

Next, a fifth embodiment of this invention will be explained by referring to FIG. 14. FIG. 14 is a circuit diagram of the electroluminescenct display device of the fifth embodiment. Only one pixel element portion is shown in the figure for the sake of simplicity. However, a plurality of pixel element portions are disposed in a matrix configuration in an actual display device. The same numerals are given to the components, that are the same as those in the first embodiment shown in FIG. 1. The explanation on those components will be omitted.

The device of this embodiment is an EL display device. The sources of the charge transfer transistors TT0–TT2 are commonly connected to the gate of an EL drive transistor 45. The EL drive transistor 45 is an N-channel type TFT. A source voltage VDD is supplied to the source of the EL drive transistor 45 and the drain of the EL drive transistor 45 is connected to an EL element 46. The El element is a luminous element that radiates light with a brightness corresponding to the amount of the electric current going through the element.

The refresh transistor 47 for initializing the gate voltage of the EL drive transistor 46 to the voltage Vsc is connected to the gate of the EL drive transistor 45. Other configurations are the same as those in the first embodiment.

The operation timing of the electroluminescenct display device described above will be explained by referring to FIG. 4. The scanning signal G1, the refresh signal RFH1 and the strobe signal STB1 are at low-level and the pixel element selection transistors GT0–GT2, the refresh transistor RT and the charge transfer transistors TT0–TT2 are all off. The scanning signal G1 becomes high from this condition for one horizontal period.

Then, the pixel element transistors GT0–GT2 turn on and the capacitance elements C0–C2 start accumulating the charge corresponding to each bit of the digital image signals D0–D2. Then, when the refresh signal becomes high-level, the refresh transistor RT turns on. The charge, which has been accumulated in the gate of the EL drive transistor 45, is discharged, initializing the voltage to the voltage Vsc.

Then, the refresh signal RFH goes down to low-level, turning the refresh transistor RT off. When the strobe signal STB becomes high afterwards, the charge transfer transistors TT0–TT2 turn on. The charge accumulated in the capacitance elements C0–C2 is fed to the gate of the EL drive transistor 45 through the charge transfer transistors TT0–TT2.

Therefore, the voltage corresponding to the digital image signals D0–D2, that is the voltage Vpix after the digital-analog conversion, is applied to the gate of the EL drive transistor 45. The electric current going through the EL drive transistor 45 changes corresponding to the voltage Vpix and the electric current going through the EL element also changes accordingly, since the conductivity of the EL drive transistor 45 changes based on the voltage Vpix. Therefore, the EL element radiates light with a brightness corresponding to the digital image signal D0–D2, enabling the multiple-depth display.

The second, third, and fourth embodiments can also be applicable to the electroluminescenct display device. That is, the signal changing switch SW for switching between the digital image signals D0–D2 and the analog image signal A0 and supplying the selected signal to the three drain signal lines 61 can also be formed in this embodiment as in the second embodiment.

Additionally, the gates of the charge transfer transistor TT0–TT2 can be connected to the gate signal line 52 of the adjacent column for supplying the scanning signal G2 in this embodiment for the sake of the simplification of the layout as well as the reduction of the pixel element area, as in the third embodiment. Also, the gate of the refresh transistor TR can be connected to the gate signal line 51 of the pixel element GS11 in this embodiment for the sake of the simplification of the layout as well as the reduction of the pixel element area, as in the fourth embodiment.

Although three-bit digital image signals D0–D2 are converted to analog signal in the first, second, third, fourth and fifth embodiments, the configuration, in which the digital-analog conversion is performed on a two-bit digital image signal or a digital image signal with more than three bits, is also included in the scope of this invention. In these cases, the numbers of the drain signal lines 61, the pixel element selection transistors, the charge transfer transistors, and the capacitance elements should be changed according to the number of the bit.

The digital image signal is converted into the analog image signal at the pixel element portion in this invention. This simplifies the configuration of the peripheral circuits of the pixel element portion, leading to the reduction of the frame area.

Also, unlike the case where a DA converter is formed within a driver circuit, there is no limitation as to the location of the DA converter, accommodating an increased number of bit of a digital image signal for forming an image.

The above is a detailed description of a particular embodiment of the invention which is not intended to limit the invention to the embodiment described. It is recognized that modifications within the scope of the invention will occur to a person skilled in the art. Such modifications and equivalents of the invention are intended for inclusion within the scope of this invention.

What is claimed is:

1. A display device comprising a plurality of pixel elements disposed in a matrix and a plurality of drain signal lines for supplying a digital image signal comprising a plurality of bit signals, each of the pixel elements comprising:

a pixel element electrode;

a plurality of pixel element selection transistors, each of the pixel element selection transistors selecting a corresponding pixel element in response to a gate scan signal fed from a corresponding gate signal line;

a plurality of capacitance elements, each of the capacitance elements being weighted according to the respective bit signal and storing a charge corresponding to the respective bit signal, the bit signal being fed from a corresponding drain signal line through a corresponding pixel element selection transistor;

a plurality of charge transfer transistors, each of the charge transfer transistors supplying the charge stored in a corresponding capacitance element to the pixel element electrode;

a signal changing switch for alternating between the digital image signal and an analog image signal and for supplying a selected signal to the drain signal lines; and a gate changing switch that connects gates of the charge transfer transistors of one of the pixel elements to the gate signal line of the pixel element disposed in a row next to the row of said one of the pixel elements in a vertical scanning sequence when the signal changing switch selects the digital image signal and supplies the selected digital image signal to the drain signal lines, and connects the gates of the charge transfer transistor of said one of the pixel elements to the gate signal line of said one of the pixel elements when the gate signal changing switch selects the analog image signal and supplies the selected analog image signal to the drain signal lines.

2. The display device of claim 1, wherein each of the pixel elements further comprises a refresh transistor that initializes a voltage of the pixel element electrode before the charge transfer transistors supply corresponding charges to the pixel element electrode.

3. The display device of claim 1 or 2, wherein each of the pixel elements further comprises a storage capacitance element for retaining the charges supplied to the pixel element electrode through the charge transfer transistors.

* * * * *